US009105982B2

(12) United States Patent
Fleck et al.

(10) Patent No.: US 9,105,982 B2
(45) Date of Patent: Aug. 11, 2015

(54) TRANSMITTING AND/OR RECEIVING DEVICE FOR INSTALLATION IN ELASTIC STRUCTURES

(71) Applicant: ContiTech Luftfedersysteme GmbH, Hannover (DE)

(72) Inventors: Andreas Fleck, Garbsen (DE); Siegfried Reck, Nienburg (DE)

(73) Assignee: ContiTech Luftfedersysteme GmbH, Hannover (DE)

( * ) Notice: Subject to any disclaimer, the term of this patent is extended or adjusted under 35 U.S.C. 154(b) by 245 days.

(21) Appl. No.: 13/848,604

(22) Filed: Mar. 21, 2013

(65) Prior Publication Data

US 2013/0214991 A1 Aug. 22, 2013

Related U.S. Application Data

(63) Continuation of application No. PCT/EP2011/064012, filed on Aug. 15, 2011.

(30) Foreign Application Priority Data

Sep. 21, 2010 (DE) ..... 10 2010 037 686

(51) Int. Cl.
*H01Q 1/36* (2006.01)
*H01Q 11/08* (2006.01)
*H01Q 1/22* (2006.01)

(52) U.S. Cl.
CPC ..... *H01Q 11/08* (2013.01); *H01Q 1/2241* (2013.01)

(58) Field of Classification Search
USPC ..... 343/873, 895
See application file for complete search history.

(56) References Cited

U.S. PATENT DOCUMENTS

| | | | | |
|---|---|---|---|---|
| 6,546,982 | B1 * | 4/2003 | Brown et al. | 152/152.1 |
| 6,836,253 | B2 | 12/2004 | Strache et al. | |
| 6,899,153 | B1 * | 5/2005 | Pollack et al. | 152/152.1 |
| 6,978,668 | B2 | 12/2005 | Starinshak | |
| 7,102,499 | B2 | 9/2006 | Myatt | |
| 7,151,495 | B2 | 12/2006 | Strache et al. | |
| 8,157,172 | B2 | 4/2012 | Fenkanyn | |
| 2003/0132893 | A1 | 7/2003 | Forster et al. | |
| 2011/0205034 | A1 | 8/2011 | Reck et al. | |

FOREIGN PATENT DOCUMENTS

| | | | |
|---|---|---|---|
| DE | 10 2006 025 326 | A1 | 12/2007 |
| EP | 1 857 305 | A1 | 11/2007 |

OTHER PUBLICATIONS

International Search Report dated Dec. 2, 2011 of international application PCT/EP2011/064012 on which this application is based.
International Preliminary Report on Patentability and Written Opinion dated Mar. 26, 2013 of international application PCT/EP20111064012 on which this application is based.

* cited by examiner

*Primary Examiner* — Tan Ho
(74) *Attorney, Agent, or Firm* — Walter Ottesen P.A.

(57) ABSTRACT

An apparatus transmits and/or receives radio waves in the UHF band and is configured for installation in an elastic structure. The apparatus includes at least one electronic component and an antenna embedded in the elastic structure. The antenna is connected to the electronic component and includes at least one filament configured to be plastically deformable and/or elastically deformable. The filament is helically wound to a predetermined antenna length (L) and defines an antenna winding turns density per cm of the antenna length. The antenna length (L) is between 4 cm and 10 cm and the antenna winding turns density lies in a range of 5 to 15 winding turns per cm of the antenna length.

12 Claims, 3 Drawing Sheets

TRANSMITTING AND/OR RECEIVING DEVICE FOR INSTALLATION IN ELASTIC STRUCTURES

CROSS REFERENCE TO RELATED APPLICATIONS

This application is a continuation application of international patent application PCT/EP2011/064012, filed Aug. 15, 2011, designating the United States and claiming priority from German application 10 2010 037 686.8, filed Sep. 21, 2010, and the entire content of both applications is incorporated herein by reference.

FIELD OF THE INVENTION

The invention relates to a transmitting and/or receiving device for installation in elastic structures, preferably polymer structures, in particular a transponder for installation in an elastomer matrix of an air spring flexible member. The transmitting and receiving device includes one or more electronic circuits or elements. The transmitting and/or receiving device has one or more antennas which are connected to the electronic circuit and embedded in an elastomer matrix of the air spring bellows. The antenna includes one or more elastically and/or plastically deformable filaments which are wound to a predetermined antenna length in the form of a helix. The transmitting and/or receiving device transmits and/or receives radio waves in the UHF band, and the invention also relates to an air spring having an air spring rolling lobe which includes such a transmitting and/or receiving device.

BACKGROUND OF THE INVENTION

United States patent application publication 2011/0205034 discloses a transponder completely embedded into the elastic matrix of the rolling-lobe flexible member of an air spring and this publication is incorporated herein by reference. Transmitting and/or receiving units are also in use, for example, in pneumatic vehicle tires. Such devices are disclosed in U.S. Pat. Nos. 6,836,253 and 6,978,668 incorporated herein by reference. In particular, U.S. Pat. No. 6,978,668 shows that the elastically conductive filaments are wound around the carrier filament or filaments with a relatively high density, that is with a high number of winding tarns per cm antenna length.

However, the range of the radio waves emitted by such devices is limited since high transmission energy levels are frequently not available.

SUMMARY OF THE INVENTION

It is an object of the invention to improve the range of the radio signals of the device described above without increasing the transmission power.

This object is achieved in that the antenna has a length between 40 and 100 mm, given a winding turns density of 5 to 15 winding turns per cm of the antenna length.

It is a further object of the invention to provide an air spring having an air spring flexible member in which the air-spring flexible member has an embedded transmitting and/or receiving unit with optimized range of the radio waves of the transmit ting and/or receiving unit.

This object is achieved in that the transmitting and/or receiving unit which is embedded in the elastomer matrix of the air spring flexible member has an antenna which has a length between 40 and 100 mm with a winding turns density of 5 to 15 winding turns per cm of antenna length.

In one embodiment of the invention, the antenna has a length of 55 mm given a winding turns density of 13.4 winding turns per cm of antenna length.

In this antenna, a relative maximum of the irradiation power occurs at 13.4 winding turns per cm and an antenna length of 55 mm. This small length has the advantage that the antenna can relatively easily be embedded in an elastomer matrix without the elastomer structure being appreciably disrupted.

Radio waves in the UHF band, that is, at a frequency of 868 MHz, have a wavelength of approximately 350 mm. Antennas for this frequency band usually have lengths of ½ lambda or ¼ lambda, wherein lambda is the wavelength. In these length ranges, changes of irradiation behavior of the antennas are to be expected as the length of the antenna changes. For a person skilled in the art it is surprising that a significant influence on the irradiation behavior of the antenna is found to occur at all when changes in length occur at still relatively short lengths.

In one embodiment of the invention, the antenna has a length of 70 mm given a winding turns density of 6.7 winding turns per cm of antenna length.

Although such an antenna has to be arranged in a somewhat less space-saving way because of the relatively large length, on the other hand, there is an over-proportional increase in the radiation of the antenna. In this embodiment it is particularly surprising that despite the relatively large antenna length, the length of the electrically conductive filament is shorter than in the embodiment above, owing to the small winding turns density, but the irradiation power has significantly increased.

In one embodiment of the invention, the windings of the electrically conductive filament are wound twice with mutually opposing lays.

As a result of this arrangement, the windings of the electrically conductive filament cross one another. This makes it possible to achieve a further increase in the range of the radio waves.

In one embodiment of the invention, the electrically conductive filament is wound around at least one carrier filament.

This arrangement has the advantage that the antenna has a relatively high degree of stability before and during the production of the elastomer matrix.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
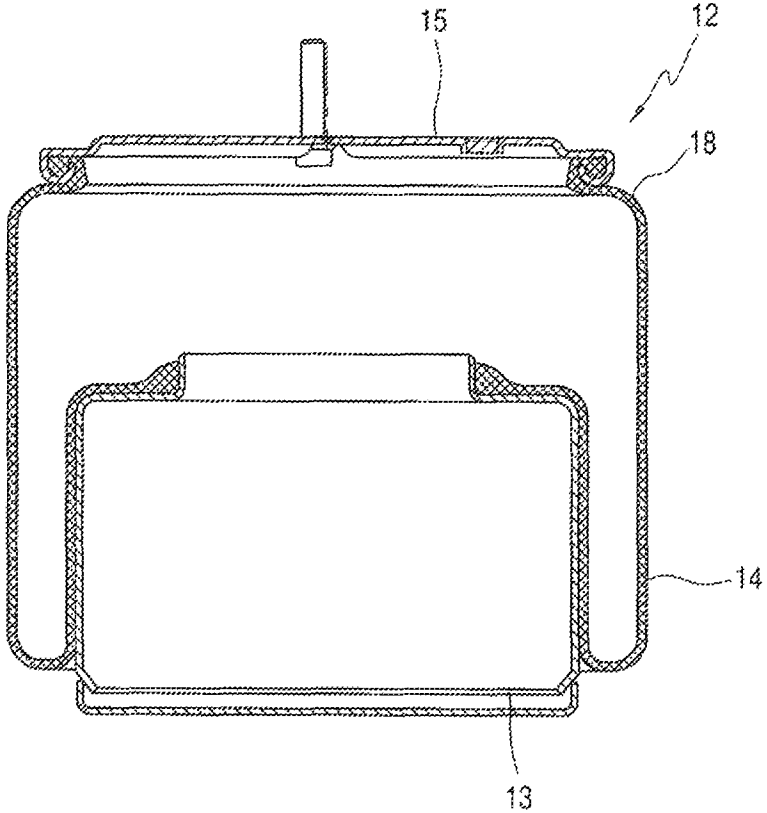
FIG. 1 is a schematic showing an air spring having a rolling-lobe flexible member including an elastomeric matrix wherein an apparatus for transmitting and receiving radio waves is embedded in the elastomeric matrix.

FIG. 1 shows an air spring 12 having a roll-off piston 13, a rolling-lobe flexible member 14 and a cover 15. An apparatus 18 for transmitting and/or receiving radio waves is embedded in the elastomer matrix 19 of the flexible member 14 and includes an electronic component 20 connected to an antenna 1 which is wound around a carrier filament 3.

Figure 2:
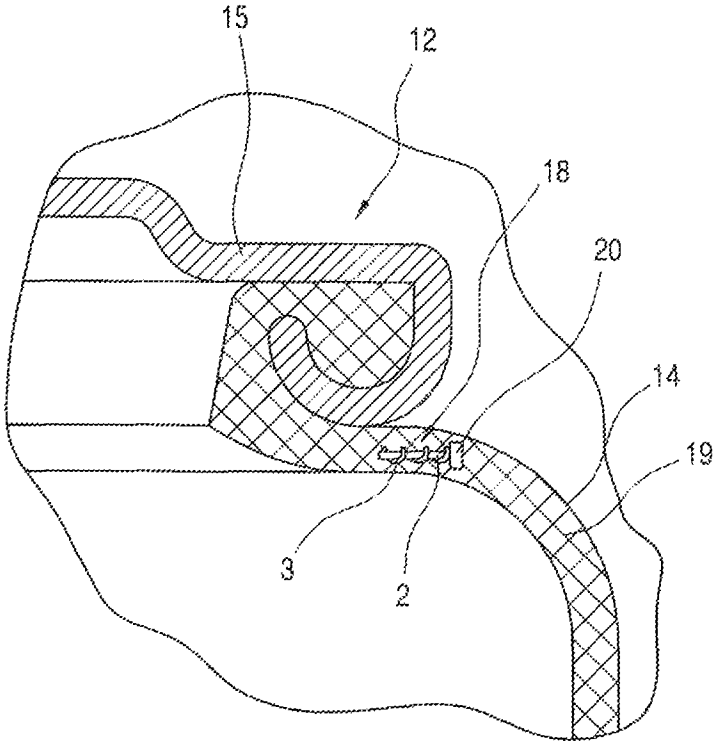
FIG. 2 is an enlarged detail of the air spring of FIG. 1 showing the apparatus for transmitting and/or receiving radio waves embedded in the electronic matrix of the rolling-lobe flexible member.

The detail view of FIG. 2 shows the electronic component 20 connected to the antenna 1.

Figure 3:
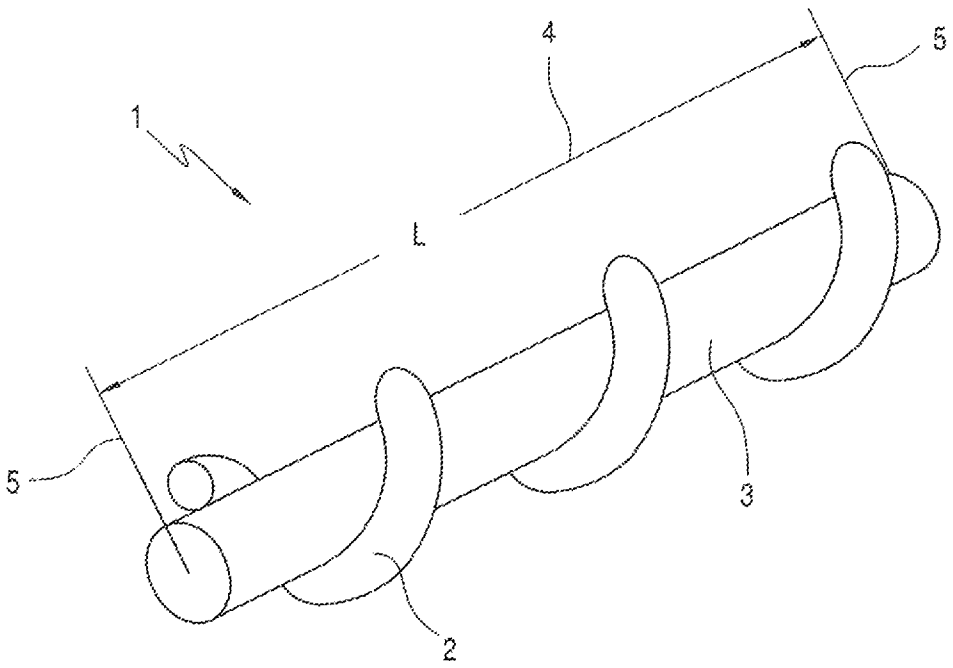
FIG. 3 is a schematic showing an antenna according to the invention.

FIG. 3 shows antenna 1 of a transmitting and/or receiving apparatus. The electrically conductive filament 2 is wound in a helical shape around an elastic carrier filament 3. The antenna 1 is embedded in an elastomer matrix 19 of an air spring flexible member.

The antenna 1 has an antenna length "L" which is identified in FIG. 3 by a dimension line 4 and ancillary dimension lines 5.

Figure 4:
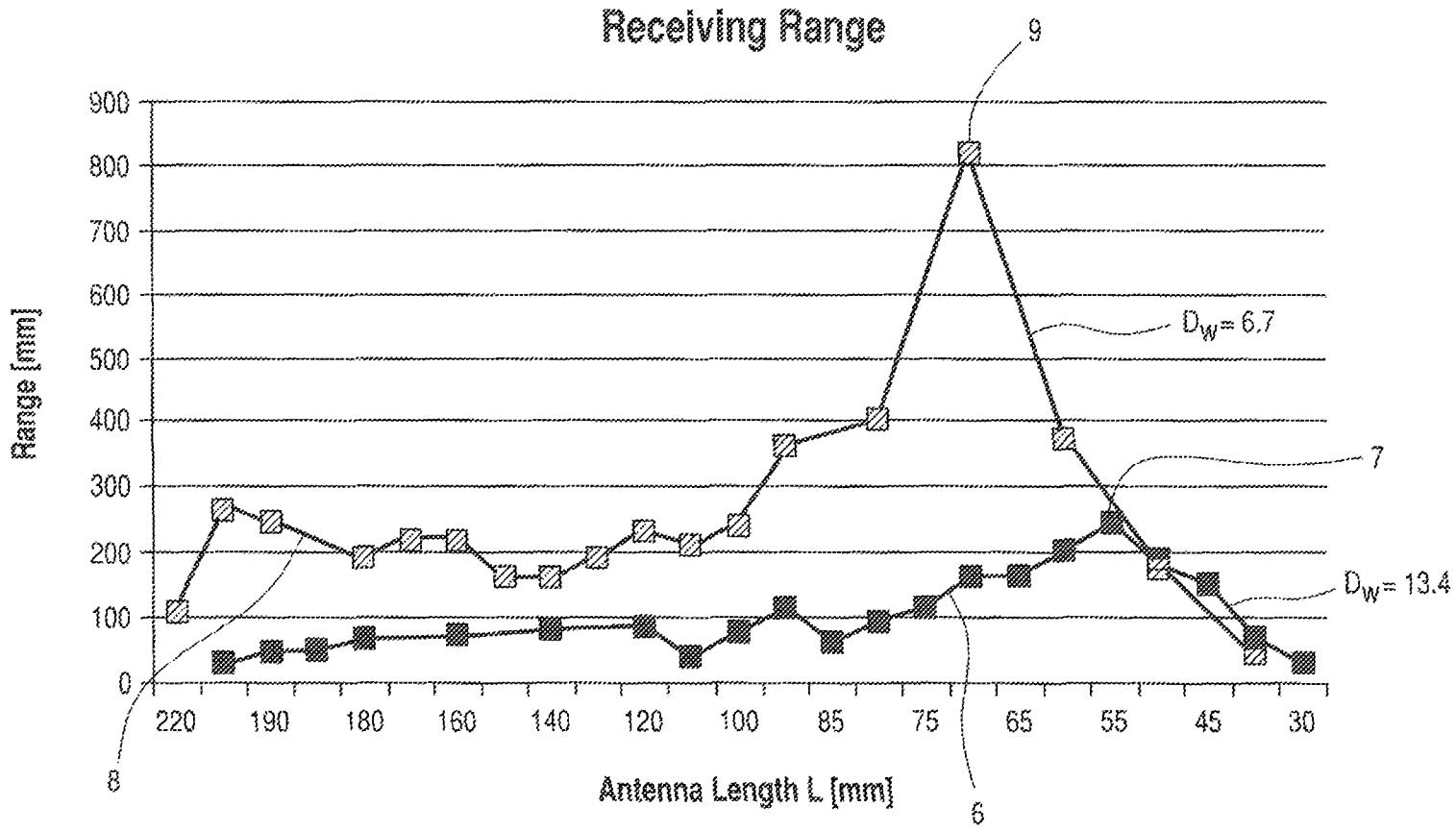
FIG. 4 is a diagram of the radio wave range as a function of the antenna length and the winding turns density.

The electrically conductive filament 2 is wound around the carrier filament 3 in three winding turns. This results in a winding turns density $D_W$ of the antenna 1 of $D_W$=3/L winding turns per antenna length FIG. 4 shows, by way of a diagram, the irradiation and therefore the range, proportional to the irradiation, of the antenna signal as a function of the winding turns density $D_W$ and of the antenna length L.

The curve 6 shows the behavior of an antenna given a winding turns density of $D_W$=13.4 winding turns/cm. It is apparent that such an antenna has a range maximum of approximately 230 mm at the point 7 if the antenna length L is approximately 55 mm. It is surprising here that when the antenna length increases the range of the antenna signals decreases.

Curve 8 shows the behavior of an antenna whose winding turns density $D_W$ is halved to $D_W$=6.7 winding turns/cm compared to the antenna described above. It is apparent than this curve 8 has a range maximum at the point 9 which occurs at an antenna length L of approximately 70 mm. Surprisingly, the signal range also decreases here as the antenna length L increases. The range of the antenna signals is almost quadrupled to approximately 830 mm compared to the antenna described above.

Although the antenna length L has increased to 70 mm at the maximum 9 in the curve 8, the absolute length of the electrically conductive filament is shorter compared to the antenna according to curve 6. This results from the calculation of the absolute number of winding turns which is directly proportional to the extended length of the electrically conductive filament.

The following applies to the point 7 on the curve 6 $D_W$=13.4 winding turns/cm; L=5.5 cm=>winding turns number w=5.5*13.4=73.7 winding turns.

The following applies to the point 9 on the curve 8 $D_W$=6.7 winding turns/cm; L=7.0 cm=>winding turns number w=7.0*6.7=46.9 winding turns.

Although the length of the electrically conductive filament is therefore smaller in the curve 8 than in the curve 6 by a factor of 0.64, the range of the irradiated signal of the antenna according to curve 8 has surprisingly increased significantly by the factor=3.6. It is therefore possible to significantly improve the irradiation power of the transmitting and/or receiving device without supplying additional energy.

It is understood that the foregoing description is that of the preferred embodiments of the invention and that various changes and modifications may be made thereto without departing from the spirit and scope of the invention as defined in the appended claims.

LIST OF REFERENCE NUMBERS (Part of the Description)

1 Antenna
2 Electrically conductive filament
3 Carrier filament
4 Dimension line
5 Ancillary dimension lines
6 Curve of the signal range for winding turns density 13.4 winding turns/cm
7 Maximum of curve 6
8 Curve of the signal range for winding turns density 6.7 winding turns/cm
9 maximum of curve 8
12 air spring
13 roll-off piston
14 rolling-lobe flexible member
15 cover
18 apparatus for transmitting and/or receiving radio waves
19 elastomer matrix of rolling-lobe flexible member
20 electronic component

What is claimed is:

1. An apparatus for transmitting and/or receiving radio waves, the apparatus being configured to be embedded in an elastic structure and comprising:

a transponder completely embedded in said elastic structure and in direct contact therewith;

an antenna completely embedded in the elastic structure and in direct contact therewith and connected to said transponder;

said antenna including an electrically conductive filament configured to be at least one of plastically deformable and elastically deformable;

said filament being helically wound to a predetermined antenna length (L) and defining an antenna winding turns density per cm of antenna length;

said antenna length (L) being between 4 cm and 10 cm; and, said antenna winding turns density being in the range of 5 to 15 winding turns per cm of antenna length causing an over-proportioned increase in radiation of said antenna within said range.

2. The apparatus of claim 1, wherein said length (L) of said antenna is 5.5 cm and said winding turns density is 13.4 winding turns per cm of antenna length.

3. The apparatus of claim 1, wherein said antenna length (L) is 7.0 cm and said winding turns density is 6.7 winding turns per cm of antenna length.

4. The apparatus of claim 1, wherein:

said filament is an electrically conductive filament; and, said winding turns are wound twice in mutually opposing lays.

5. The apparatus of claim 1, wherein said radio waves are in the UHF band.

6. An apparatus for transmitting and/or receiving radio waves, the apparatus being configured for installation in an elastic structure and comprising:

at least one electronic component;

an antenna embedded in the elastic structure and connected to said electronic component;

said antenna including at least one filament configured to be at least one of plastically deformable and elastically deformable;

said filament being helically wound to a predetermined antenna length (L) and defining an antenna winding turns density per cm of antenna length;

said antenna length (L) being between 4 cm and 10 cm;

said antenna winding turns density being in the range of 5 to 15 winding turns per cm of antenna length;

said filament being an electrically conductive filament;

at least one carrier filament; and, said electrically conductive filament being wound around said carrier filament.

7. An air spring comprising:

a rolling-lobe flexible member defining an elastomer matrix;

an apparatus configured for at least one of transmitting radio waves and receiving radio waves;

said apparatus including a transponder completely embedded in said elastomer matrix and in direct contact therewith;

said apparatus further including an antenna completely embedded in said elastomer matrix of said rolling-lobe flexible member and said antenna including at least one electrically conductive filament configured to be at least one of elastically deformable and plastically deformable;

said antenna being operatively connected to said transponder; and, said filaments being helically wound to a predetermined antenna length (L) in the range of 4.0 to 10.0 cm at a winding turns density of 5 to 15 winding turns per cm of antenna length causing an over-proportioned increase in radiation of said antenna within said range.

8. The air spring of claim 7, wherein said antenna length (L) is 5.5 cm at a winding turns density of 13.4 winding turns per cm of antenna length.

9. The air spring of claim 7, wherein said antenna length (L) is 7.0 cm at a winding turns density of 6.7 winding turns per cm of antenna length.

10. The air spring of claim 7, wherein:

said filament is an electrically conductive filament;

said filament defines a plurality of winding turns; and, said winding turns are wound twice in mutually opposing lays.

11. The air spring of claim 7, wherein said radio waves are in the UHF band.

12. An air spring comprising:

an air spring flexible member defining an elastomer matrix;

an apparatus configured for at least one of transmitting radio waves and receiving radio waves;

said apparatus being embedded in said elastomer matrix and including at least one electronic component;

said apparatus having an antenna embedded in said elastomer matrix of said air spring flexible member and said antenna including at least one filament configured to be at least one of elastically deformable and plastically deformable;

said antenna being operatively connected to said electronic component;

said filaments being helically wound to a predetermined antenna length (L) in the range of 4.0 to 10.0 cm at a winding turns density of 5 to 15 winding turns per cm of antenna length;

said filament being an electrically conductive filament;

a carrier filament; and, said electrically conductive filament being wound around said carrier filament.

* * * * *